United States Patent [19]

Kenwell

[11] 4,111,566

[45] Sep. 5, 1978

[54] TRAVELLING HAND SUPPORT

[76] Inventor: Edward A. Kenwell, 21 Meadowbrook Dr., Somerville, N.J. 08876

[21] Appl. No.: 689,539

[22] Filed: May 24, 1976

[51] Int. Cl.[2] ..... A46B 5/02

[52] U.S. Cl. ..... 401/6; 401/48

[58] Field of Search ..... 401/6–8, 401/48; 15/443–445, 114

[56] References Cited

U.S. PATENT DOCUMENTS 338,239 3/1886 Wyche ..... 15/443 X 1,438,114 12/1922 Hume ..... 401/6

3,972,628 8/1976 Stevers ..... 401/6

FOREIGN PATENT DOCUMENTS 1,461,322 3/1969 Fed. Rep. of Germany ..... 401/6

*Primary Examiner*—Stephen C. Pellegrino

[57] ABSTRACT

A travelling hand support allows writing by a handicapped person who need only be able to move his shoulder. The support is adapted to fix the position of a writing instrument and to permit the shoulder movement to apply the pressure necessary for writing.

3 Claims, 3 Drawing Figures

TRAVELLING HAND SUPPORT

FIELD OF THE INVENTION

This invention relates to hand supports used primarily as a writing aid for the handicapped.

BACKGROUND OF THE INVENTION

A number of hand supports for aiding the handicapped to write is known. Many of these supports require the writing instrument, pen or pencil, to be gripped during use and include a bearing surface for movement across the paper. Such supports have not become popular because most people who have writing disabilities due to some handicap have a great deal of trouble holding a pen or pencil and applying pressure to write. Other know supports provide a relatively large rollable or slideable support to be grasped by the entire hand. But these too either require the pen or pencil to be held by the fingers or affixed to the support. In the first instance, as before, many handicapped persons are unable to use the support. In the latter, it is difficult to maintain sufficient pressure to enable the instrument to write.

BRIEF DESCRIPTION OF THE INVENTION

The present invention is based on the realization that a holder for a writing instrument can be cantilevered from a travelling hand support such that only little shoulder movement is required to provide the pressure necessary for writing. A large hand support is adapted to provide a bottom surface which is beveled to allow such slight shoulder movement to tilt the support in a manner to apply the requisite pressure.

DETAILED DESCRIPTION

Figure 1:
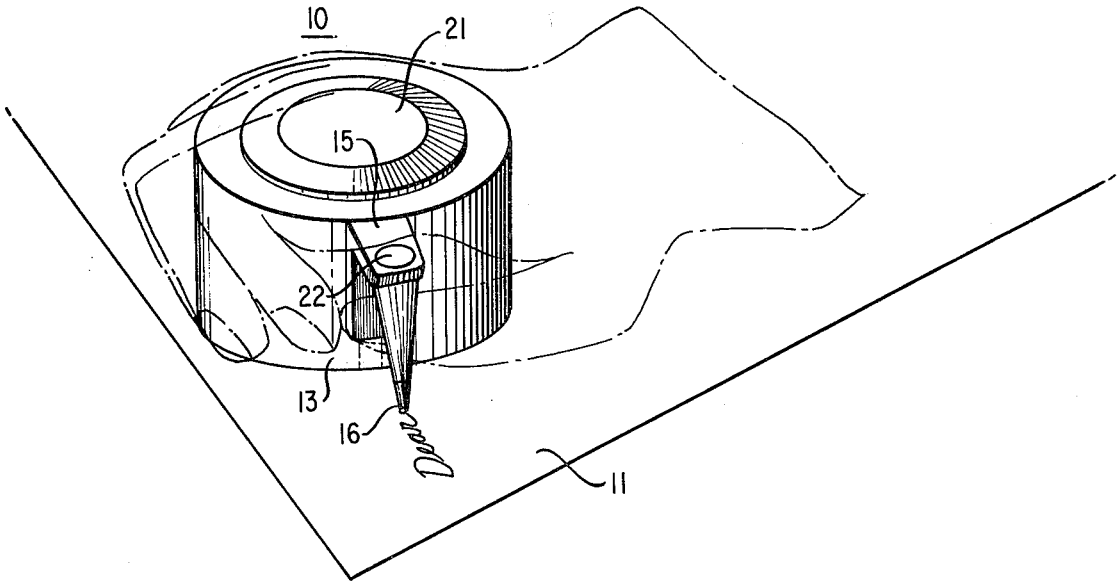
FIGS. 1, 2 and 3 show a perspective view, a top view and a cross section view of a support in accordance with this invention.

FIG. 1 shows a travelling hand support 10 in accordance with this invention. The support can be seen to be large so that it fully occupies the space defined by a cupped hand as shown. The support makes contact with a sheet of paper 11 at its bottom surface 13.

Surface 13 is beveled so that the support can tip. Arm 15 is adapted to extend from the main body of the support and to fix a writing utensil 16 in position as shown. When support 10 is in an upright position in the illustrative embodiment utensil 16 is not in contact with paper 11. But when support 10 is tipped it rides on beveled surface $13_b$ and utensil 16 is in contact with paper 11. However, it should be clear that the opposite relationship can be realized if arm 15 is attached to the opposite position of the main body of the support.

Figure 2:
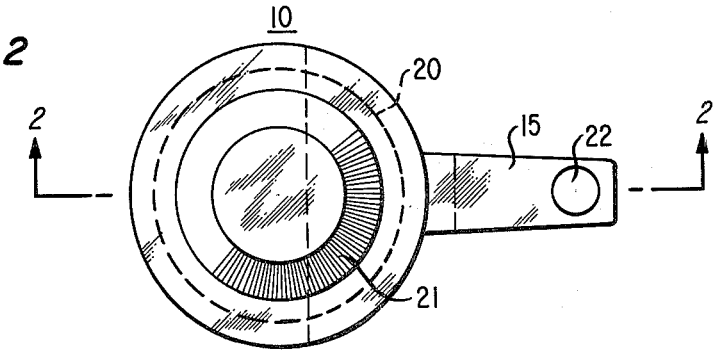
Figure 3:
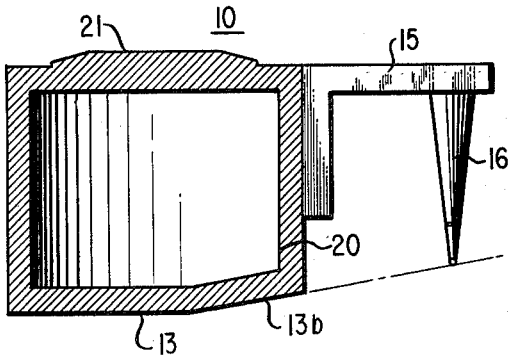

FIGS. 2 and 3 show top and cross sectional views of support 10. The alignment of the tip of the writing utensil and beveled surface $13_b$ is clear from FIG. 3 which is a cross section taken along line 2—2′ of FIG. 2. The support can be seen to be arranged so that normally surface 13 contacts paper 11 and utensil 16 is out of contact with paper 11.

A recitation of typical dimensions of the support indicates proper utensil alignment, tilt operation and normal disposition of an unattended support. In one particular embodiment, the support had a diameter of 2 inches and a height of 1.67 inches. Surface 13 was 1.15 inches to the point where the bevel started and the beveled surface made an angle of 15° with surface 13. The height of the support at the end of the beveled surface was 1.54 inches. The arm 15 was 1.06 inches long to the center point of the writing utensil and the distace from the top of arm 15 to the bottom of utensil 16 was 1.35 degree inches. The beveled surface was 0.85 inches wide.

The support is designed so that the tip operation for bringing say pen 16 into contact with paper 11 is responsive to shoulder motion alone. Moreover, once tipped, the support applies pressure necessary for writing without adjustment of any type and without requiring finger or arm movement. The pen is initially an upright position and is not only properly tipped during use but also provides pressure automatically. The arrangement is particularly well adapted for ball point pens.

The support is preferrable light and made of Aluminum but, of course can be made of other materials such as plastics. Conveniently, the support may include an inner chamber 20 to which access is provided via lid 21. Chamber 20 may be adapted to hold extra pens which are conveniently attached at point 22 of FIGS. 2 and 3.

What has been described is considered merely illustrative of the principles of this invention. Therefore, various modifications of this invention can be devised by those skilled in the art in accordance with those principles within spirit and scope of the invention as claimed. For example, a support may be made with a weight distribution such that it resides normally in a tipped position with the pen and surface $13_b$ normally being in contact with the paper.

What is claimed is:

1. A hand support adapted to be cupped by the hand and having a bottom surface, said bottom surface including a beveled portion and being adapted to provide first and second flat bearing surfaces when said support resides in first and second positions respectively for movement with respect to a writing surface, wherein said support includes an arm cantilevered from said support and adapted to support a writing utensil, said utensil being in a position and of a length such that the tip thereof is in alignment with the plane of said first surface and thus in contact with said writing surface when said support is in said first position.

2. A hand support in accordance with claim 1 being of a design to reside normally in said second position.

3. A hand support in accordance with claim 2 wherein said second and first positions comprise upright and tilted positions respectively.

* * * * *